US005538359A

United States Patent [19]

Wadle et al.

[11] Patent Number: 5,538,359

[45] Date of Patent: Jul. 23, 1996

[54] QUICK RELEASE BOOM CONNECTOR

[76] Inventors: Barry Wadle, 78 Avenue of Two Rivers, Rumson, N.J. 07760; Jerry Woerner, 83 Jersey Ave., Edison, N.J. 08820; Arthur Roesler, 50 Pleasant La., Green Pond, N.J. 07435

[21] Appl. No.: 272,240

[22] Filed: Jul. 8, 1994

[51] Int. Cl.[6] ..... E02B 15/04

[52] U.S. Cl. ..... 405/70; 405/63; 405/66

[58] Field of Search ..... 405/60, 63, 64, 405/66, 70, 72; 403/11, 331, 375, 376, 380

[56] References Cited

U.S. PATENT DOCUMENTS

| | | | |
|---|---|---|---|
| 3,174,781 | 3/1965 | Eastman | 403/376 |
| 3,685,296 | 8/1972 | Bogosian | 405/70 |
| 3,807,178 | 4/1974 | Tanksley . | |
| 3,818,708 | 6/1974 | Benson . | |
| 3,848,417 | 11/1974 | Smith et al. . | |
| 3,906,732 | 9/1975 | Tedeschi, Jr. . | |
| 4,016,726 | 4/1977 | Campbell et al. . | |
| 4,124,981 | 11/1978 | Preus | 405/66 |
| 4,155,664 | 5/1979 | Acheson | 403/317 |
| 4,295,756 | 10/1981 | Blair | 405/70 |
| 4,367,979 | 1/1983 | Milligan | 405/70 |
| 4,723,666 | 2/1988 | Nichols | 403/331 X |
| 5,114,272 | 5/1992 | Brunhoff et al. | 405/66 |
| 5,190,402 | 3/1993 | Vick | 405/70 |

FOREIGN PATENT DOCUMENTS

| | | | |
|---|---|---|---|
| 196278 | 5/1965 | Sweden | 405/70 |
| 600239 | 3/1978 | U.S.S.R. | 405/70 |

*Primary Examiner*—Eric K. Nicholson
*Assistant Examiner*—John A. Ricci
*Attorney, Agent, or Firm*—Lahive & Cockfield

[57] ABSTRACT

A remotely disconnectable floating containment boom includes male and female portions of a connector and a release element which holds the male and female portions together when they are operatively engaged. The containment boom includes a remote activating element attached to the release element. The remote activating element can disengage the release element from the male and female portions of the boom sections from a remote location, thereby permitting the boom sections to disconnect and separate.

7 Claims, 10 Drawing Sheets

QUICK RELEASE BOOM CONNECTOR

BACKGROUND OF THE INVENTION

This invention relates to floating booms and more particularly to floating containment booms which are used to contain spills of oil and other combustible liquids.

Containment booms are floating barriers which surround an area of water during the transfer of fuels or other combustible liquids. In the event of a fuel spill, the containment boom acts as a floating fence to contain and confine the spilled product to a relatively small area until it can be safely and completely removed. Containment booms thus facilitate cleanup and prevent the spread of the spilled fuel, thereby reducing the risks of danger to personnel and damage to the environment and to other nearby natural and manmade structures.

The "flash point" of a combustible material is the lowest temperature at which the vapor of the material ignites spontaneously in air. Liquids which have a low flash point are typically relatively volatile and tend to vaporize at ambient temperatures and pressures. Low flash point materials are likely to ignite under ambient conditions in the event of a spill and thus present a comparatively greater danger of explosion during transfer. The term "low flash point", as used herein, means those combustible materials having a flash point temperature of less than 100° C.

On the other hand, high flash point liquids are generally less volatile and are less likely to ignite under ambient conditions. High flash point liquids present a comparatively low risk of explosion during transfer or in the event of a spill but, if spilled, the high flash point product remains in and on the surface of the water, with potentially serious consequences to the environment, property and marine life, until it is removed. The term "high flash point", as used herein, means those combustible materials having a flash point temperature of greater than 100° C.

The flash point of a combustible liquid is important in determining whether a containment boom is used during transfer of such liquids. Booms are used (and in some jurisdictions are required) for the transfer of a relatively high flash point, low volatility product. The boom can contain any spills of the high flash point product in a relatively small, confined area until the spill is cleaned up. On the other hand, the transfer of a relatively low flash point, high volatility product preferably occurs in an unboomed area, so that any spills of the low flash point product are free to volatilize and dissipate away from the fuel transfer site. This reduces the risk of ignition and explosion of the spill and of nearby combustible liquids.

When numerous transfers of a variety of combustible liquids are planned, e.g., the filling of fuel tankers, repeated installation and removal of a containment boom around the transfer area becomes labor-intensive, time-consuming and therefore costly. Demurrage of vessels as a result of time delays associated with installation and removal of containment booms and the serial transfer of one product at a time further increases the product costs. Accordingly, careful scheduling and planning are required to minimize "downtime" and cost. Further, serial transfer of combustible liquids between compartmentalized tanks or vessels creates significant and potentially catastrophic mechanical stresses within the empty compartments of a receiving tank or vessel because of concentrated and unbalanced loads during product transfer. The term "vessel", as used herein, means any movable marine vessel, such as a tanker, ship, barge or the like, or any stationary vessel, such as a loading or receiving tank, vessel or the like located on land, or on a dock, pier or other stationary structure.

Containment booms typically comprise individual boom sections or partitions which link interchangeably for ease in installation and removal. Each boom section is normally about one hundred feet long and ends in a boom connector which links another boom section in a relatively liquid-impermeable engagement to prevent the leakage of fluids. After the need for containment is past, the boom sections are disengaged from one another to facilitate their removal, transportation and storage.

Engagement and disengagement of the boom sections generally requires the labor of one or more operators to place and secure the boom sections together in the water. Boom operators thus require transportation to and from the boom site, typically in combustion engine-powered water craft. These craft must stay near the boom if the boom is to be used during the transfer of low flash point materials because there may be an instant need for boom disconnection. However, the presence and operation of such craft in or near the containment area itself creates a risk of explosion of combustible liquids from the engines and thus presents a potential danger to life and property. Further, the labor and time required to install and remove a containment boom during a fuel transfer process increases the time required for transfer and thus the detention of the loading and transferring vessels, and hence increases the ultimate costs of the fuel.

Prior art containment booms include various mechanisms for disconnecting boom sections. For example, U.S. Pat. No. 3,818,708 to Benson discloses a containment boom having hinged sections held together with a removable straight pin which extends vertically through the hinge. U.S. Pat. No. 4,016,726 to Campbell et al. discloses a connector hinge for a containment boom having male and female portions held together with a clevis pin. U.S. Pat. No. 4,295,726 to Campbell et al. discloses a connector hinge for a containment boom having male and female portions held together with a clevis pin. U.S. Pat. No. 4,295,756 to Blair, U.S. Pat. No. 5,190,402 to Vick and U.S. Pat. No. 3,848,417 to Smith et al. each disclose a containment boom connector having interlocking plates held together with a releasable, clevis-type pin. U.S. Pat. No. 4,155,664 to Acheson discloses a containment boom connector having interlocking plates held together with a sliding pivot pin.

None of the described prior art devices permits quick, remote disengagement of the boom sections. Disengagement of the Benson boom connector from a remote location is difficult if not impossible because of the vertical orientation of the pin in the hinge.

It would be advantageous from the perspective of safety and efficiency to provide a containment system which alleviates or eliminates the above-described disadvantages in the transfer of combustible liquids.

It is thus an object of the invention to provide a containment boom which can be easily and quickly installed and removed.

It is a further object of the invention to provide a containment boom which can be easily and quickly disconnected from a remote location.

It is a further object of the invention to facilitate the transfer of combustible liquids by the use of a containment boom which can be easily and quickly disconnected from a remote location.

It is a further object of the invention to provide a method for transferring two or more combustible liquids, including a low flash point liquid, at one time within a boomed area without resetting or removing the boom.

A containment boom according to the present invention includes a boom connector which can be quickly and remotely disconnected. The sections of the boom connector mate in a male-female engagement and include one or more release elements which hold the mating sections together. Remote activation of a release mechanism attached to the release element disengages the release element holding the male and female portions of the boom connector together. The combined action of waves, wind and current causes the disconnected boom sections to drift apart from one another, thereby opening the containment area. The remotely disconnectable boom connector thus permits quick and easy disconnection of a containment boom from a location distant from the boom, such as a pier or transfer vessel. Use of a remotely disconnectable boom connector also permits the simultaneous transfer of both low- and high flash point liquids, because the containment boom can contain the area in the event of a high flash point product spill and yet can be quickly and remotely disconnected in the event of a low flash point product spill.

Accordingly, one embodiment of a remotely disconnectable containment boom includes a first boom section having a female portion of a quick release boom connector affixed thereto and a second boom section having a male portion of a quick release boom connector affixed thereto. The female portion of the connector includes a pair of spaced parallel walls which extend along a first axis. Each of the walls has a channel extending through it perpendicular to the first axis. A transverse member extends between the walls perpendicular to the first axis. An alignment element is mounted externally to one of the walls.

The male portion of the connector has a single wall extending along a second axis and further includes a transverse member engaging element which in operation engages with the transverse member on the female portion of the releasable boom connector. The single wall of the male portion also has a channel extending through it perpendicular to the second axis. When the male and female portions of the releasable boom connector are operatively engaged, i.e., with the single wall of the male portion inserted between the walls of the female portion, the first axis and the second axis overlap and the channels in each of the walls are collinear with the alignment element on one of the walls of the female portion. The quick release boom connector further includes a securing element which can be removably disposed within the channels of the male and female portions of the boom connector to secure them together when they are operatively engaged. The connector further includes a remote activating element attached to the securing element. This remote activating element is used to remove the securing element from the channels in the male and female portions of the connector from a remote location.

Another aspect of the invention is a different remotely disconnectable containment boom. This boom also has a first boom section with a female portion of a quick release boom connector affixed thereto and a second boom section with a male portion of a quick release boom connector affixed thereto. The female portion of the connector includes a pair of spaced parallel walls which extend along a first axis. The female portion further includes a lock element which is pivotably mounted on the exterior of at least one of the walls. An alignment element is also mounted on the exterior of the same wall. The male portion of the connector has a single wall extending along a second axis and further includes a lock engaging element for engagement with the lock element on the female portion of the connector when the male and female portions are operatively engaged, i.e., with the single wall of the male portion inserted between the walls of the female portion. The quick release boom connector further includes a remote activating element passing through the alignment element and attached to the lock element for disengaging the lock element from the lock engagement element from a remote location.

In a preferred embodiment of the invention, the containment boom further includes a stiffening element mounted on the boom sections near the connector.

Another feature of the invention is embodied in a method of remote disconnection of a containment boom. A containment boom having a quick release boom connector with male and female portions affixed thereto and a remote activating element as described above is provided. An operator located remotely from the boom activates the remote activating element to disconnect the boom connector, such as by removing a securing element from channels disposed in each portion, or by disengaging a lock element on the female portion of the connector from a lock engaging element on the male portion of the connector.

Another feature of the invention is embodied in a method of simultaneously transferring two or more combustible liquids between a loading vessel and a receiving vessel, wherein at least one of the vessels is in water and where at least one of the combustible liquids has a low flash point. A remotely disconnectable containment boom according to the invention is placed in the water surrounding the vessels. The combustible liquids are simultaneously transferred from the loading vessel into respective separate compartments of the receiving vessel. If the low flash point liquid spills into the water during the transfer, the remotely disconnectable containment boom is disconnected from a remote location by activation of a remote activating element attached to the connector, thereby opening the boom and permitting the liquid to dissipate away from the vessels. On the other hand, if the high flash point product spills, it will be contained.

These and other features of the invention will be more fully appreciated with reference to the following detailed description which is to be read in conjunction with the attached drawings.

DETAILED DESCRIPTION OF THE INVENTION

Figure 1A:
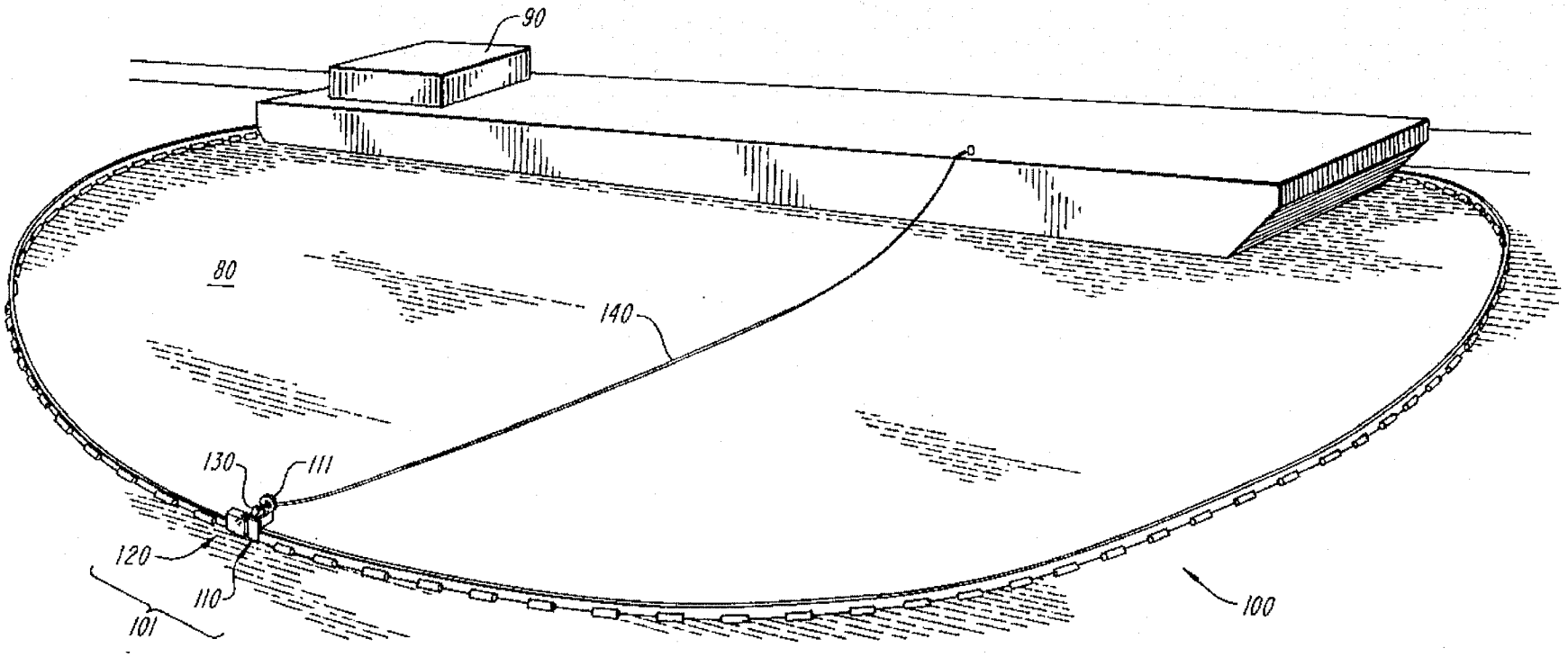
FIGS. 1A and 1B are perspective views of the operation of a remotely disconnectable containment boom according to the invention.

With reference more particularly to the drawings, common structures to the various embodiments discussed herein are labeled with common reference numerals having superscripted primes. FIG. 1A illustrates a remotely disconnectable containment boom 100 installed in a body of water 70 around a vessel, barge or stationary pier 90. The containment boom 100 surrounds a portion of the pier 90 and a body of water 80 adjacent to the pier. The containment boom has a quick release remotely disconnectable connector 101 which connects a female portion 112 of a first boom section 110 with a male portion 122 of a second boom section 120. A removable securing element 130 holds the female portion 112 and the male portion 122 of the boom sections 110 and 120 together when they are operatively engaged. The securing element 130 attaches to a remote activating element 140 through an alignment element 111 on the female portion 112 of the connector 101. The remote activating element 140 attaches at its distal end to the pier 90 or to some other structure remote from the boom connector 101.

Figure 1B:
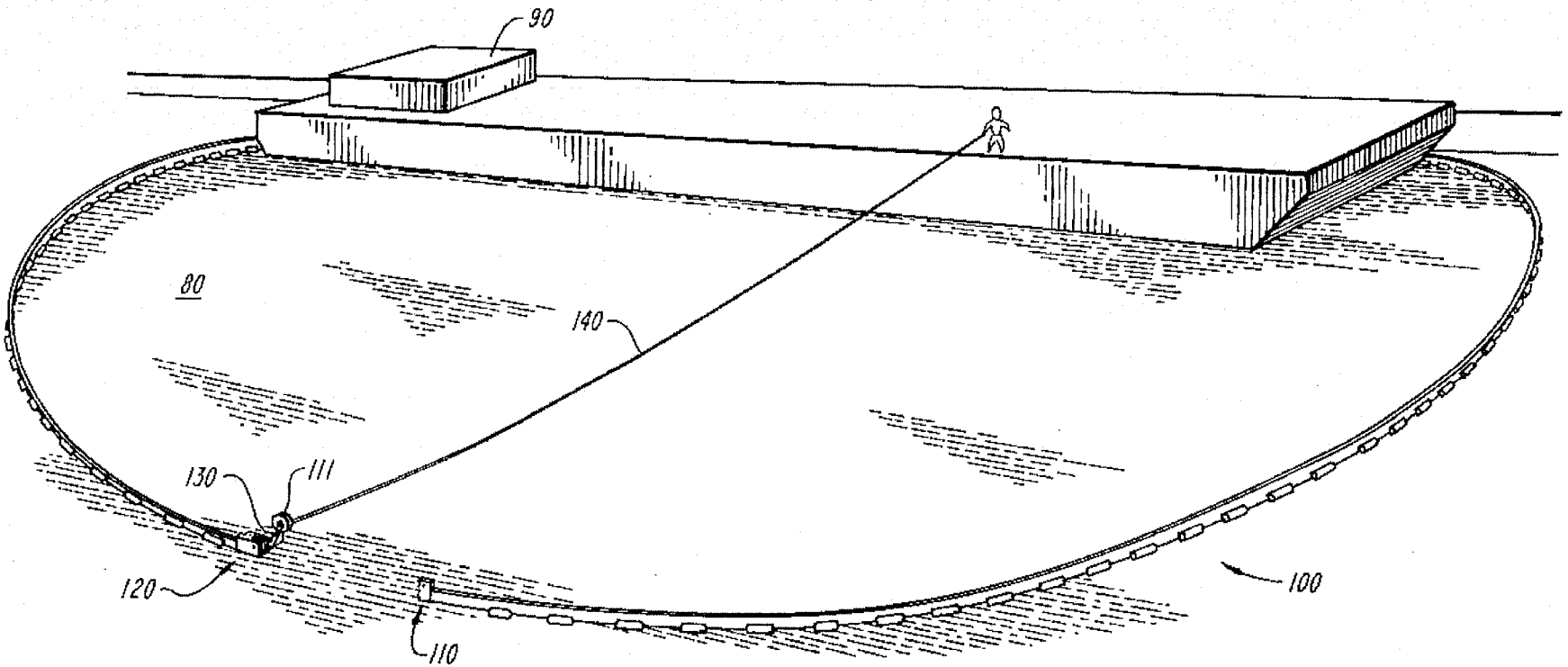

In FIG. 1B there is shown a remotely disconnectable containment boom 100 which has been remotely disconnected by disengagement of the female portion 112 from the male portion 122 of the boom sections 110 and 120, respectively, by remote activation of the activating element 140 from the pier 90. Disengagement of a release element 130 from the female portion 112 and the male portion 122 of the boom sections 110 and 120 permits the sections to separate from each other with assistance from surface wind, waves or current, thereby opening the boom. The release element 130 attaches to the remote activating element 140 through an alignment element 111 on the female portion 112 of the first boom section 110 and thus stays with the activating element 140 and boom section 110 upon its release from the boom connector 101.

FIGS. 2–7 illustrate alternative embodiments of a quick release boom connector 101 in greater detail. In both embodiments of the invention, the connector 101 comprises first and second boom sections 110 and 120. The first boom section 110 includes a female portion 112 which can be integral with the first boom section 110, or it can be a separate part secured to the first boom section 110 with fastening elements, such as a bolt 113, a nut 115 and a washer 117. Similarly, second boom section 120 includes a male portion 122 which can be integral with the second boom section 120, or it can be a separate part secured to the second boom section 120 in a similar manner.

Figure 2:
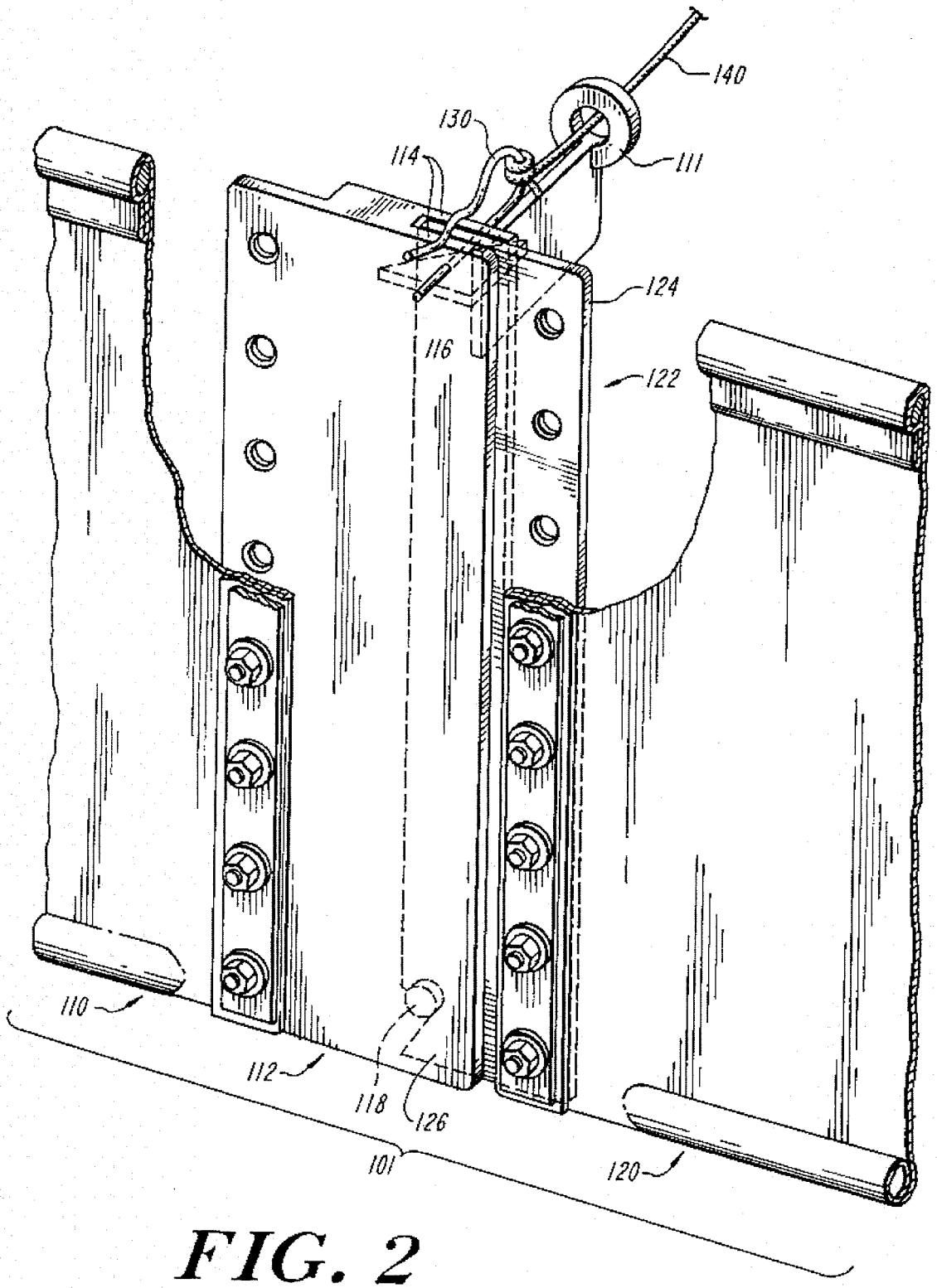
FIG. 2 is a perspective and partial cutaway view of a quick release boom connector according to one embodiment of the invention.

In the embodiment of the invention shown in FIG. 2, the female portion 112 has a pair of walls 114 spaced apart in parallel relationship to one another and extending along a first axis. The space between the walls 114 is slightly greater than the width of the male portion 122 of the second boom section 120 so that the male portion 122 fits easily between the walls 114 without excessive play. The walls 114 of the female portion 112 are joined at one edge, such as by welding.

The second boom section 120 includes a male portion 122 which extends along a second axis and fits between the parallel walls 114 of the female portion 112 of the connector. The male portion 122 of the connector 101 is preferably a single plate 124 which is sufficiently narrow to fit removably and replaceably between the two walls 114 without excessive play, such that the first and second axes overlap. In one embodiment of the invention, as shown in FIGS. 3B and 3C, the male portion 122 further includes a channel 128 substantially similar to, and collinear with, the channels 116 in the female portion 112 when the male and female portions of the connector are operatively engaged. The channel 128 extends through the plate 124 perpendicular to the first and second axes and is preferably of a sufficient size to permit passage of the securing element 130 therethrough without binding or interference. In a preferred embodiment, the leading edge of the male portion can be tapered slightly inwardly, and the walls of the female portion can be angled slightly outwardly, to effect a self-guiding wedge fit and proper alignment of the channels in the male and female portions when they are operatively engaged.

Figure 5A:
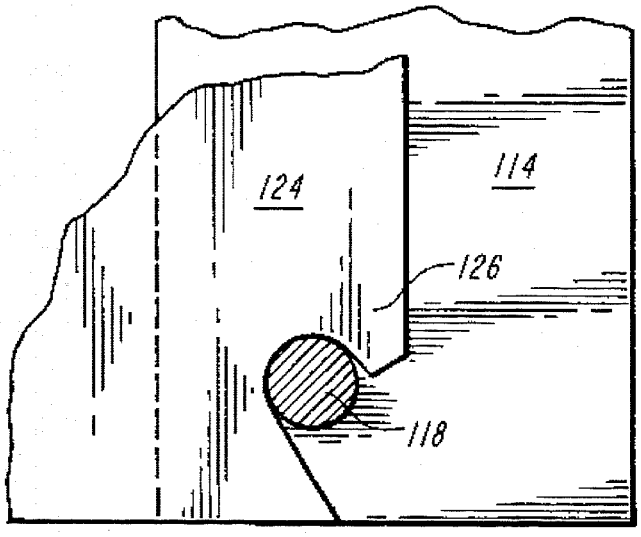
FIGS. 5A–5B are section views of a quick release boom connector having a transverse member and a transverse member engaging element according to one embodiment of the invention.

At an opposite end of the male portion 122 from the channel 128 is a transverse member engaging element 126. As shown in FIG. 5A, the transverse member engaging element 126 is a notch or lip which is open at one end for engagingly receiving the transverse member 118. The opening of the transverse member engaging element 126 is preferably larger than the largest diameter or cross-sectional dimension of the transverse member 118 so that the transverse member 118 slips easily into and out of the transverse member engaging element 126. In a preferred embodiment, the transverse member engaging element 126 is a notch that opens downwardly and forms an acute angle with respect to the second axis. The orientation of the transverse member 118 and transverse member engaging element 126 facilitates remote disconnection of the male and female portions 122 and 112 of the boom connector 101 by stabilizing the boom connector in the water and thereby preventing pinching of the securing element 130 between the male and female portions during relative movement of the boom sections during disconnection.

In the embodiment shown in FIG. 2, a channel 116 extends through each of the respective walls 114 near one end of each of the walls along a third axis perpendicular to the first and second axes. The channels 116 are preferably of a sufficient size to permit passage of a securing element 130 therethrough without binding or interference, although the size and cross-section of the channels 116 will depend on the dimensions of the particular securing element used.

Figure 7:
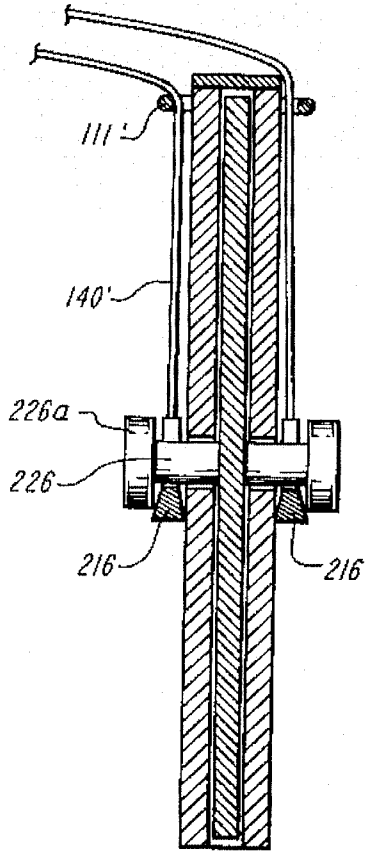
FIG. 7 is a sectional view of the boom connector in a second embodiment of the invention.
Figure 6A:
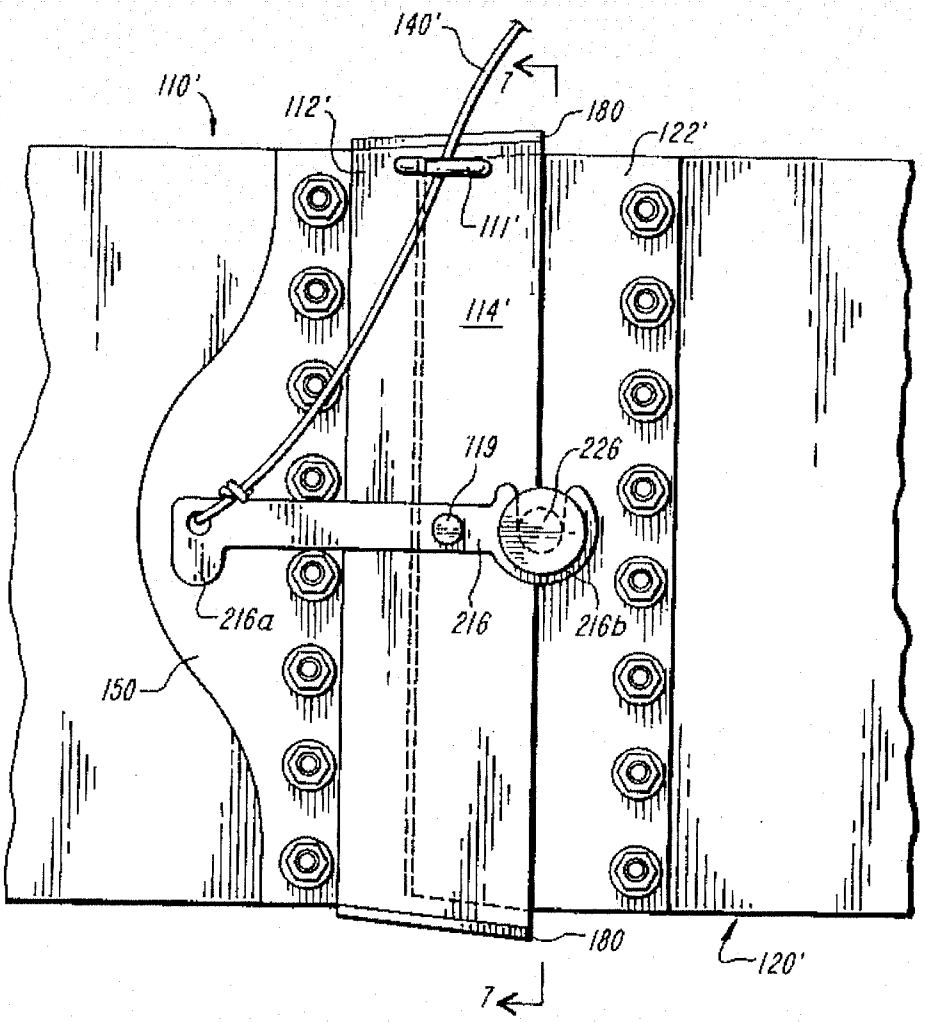
FIGS. 6A–6B are side elevational views of a quick release boom connector according to a second embodiment of the invention.
Figure 6B:
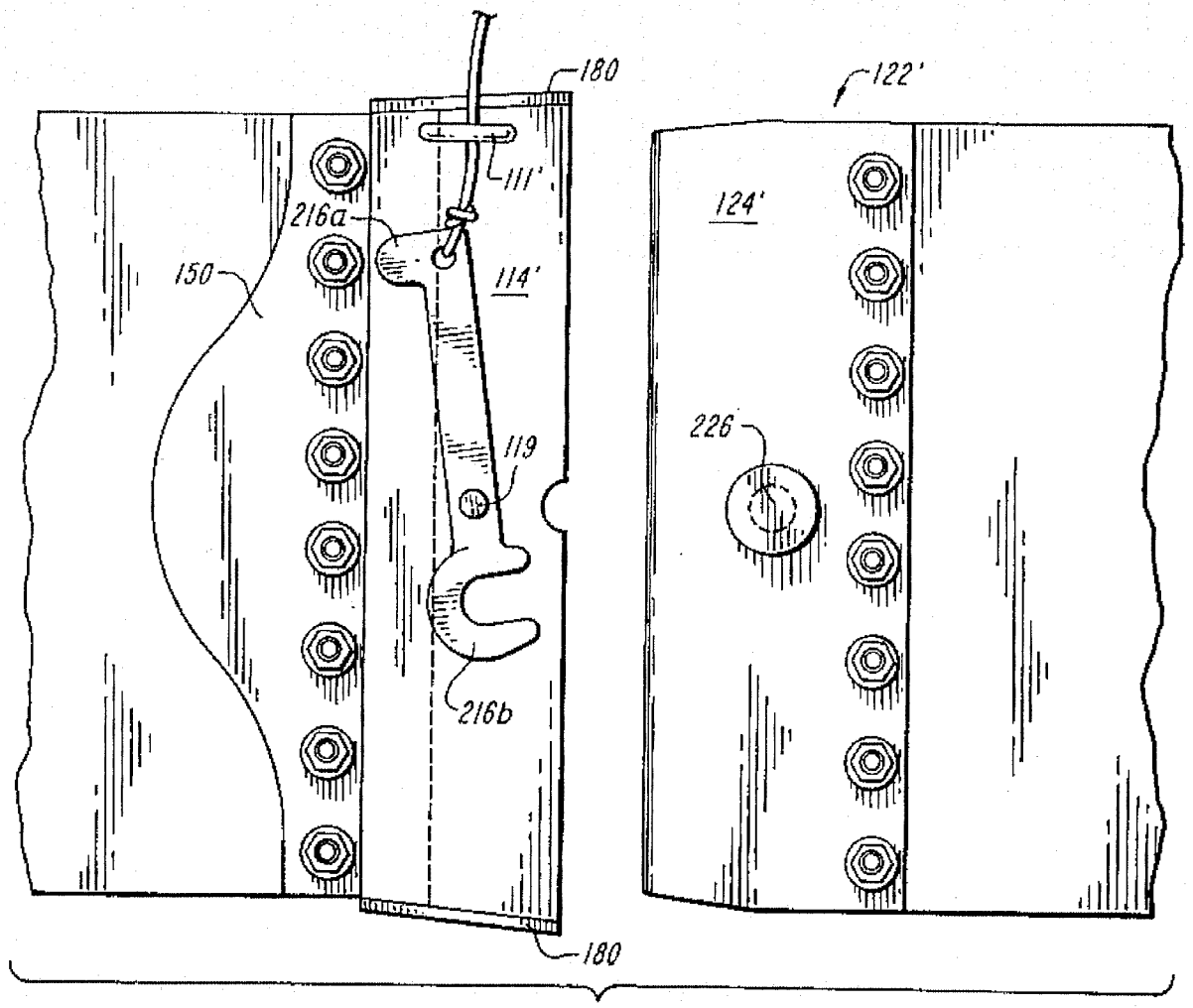

An alignment member 111 is mounted externally of the walls 114 near the channels 116. In one embodiment of the invention the alignment member 111 is preferably mounted external to the wall facing the contained area 80, as shown in FIGS. 1A and 1B. The alignment member 111 preferably includes a "sight" or opening spaced apart from and collinear with the channels 116 along the third axis, as shown in FIGS. 2, 3 and 4. In another embodiment of the invention, the alignment element 111' is mounted on one wall 114 on the female portion 112 and extends perpendicular to the first axis, as shown in FIGS. 6A, 6B and 7. The alignment member 111 is preferably an eyelet-containing device having an opening which is sufficiently large to permit passage of a heavy rope, cable or wire therethrough, yet sufficiently small to prevent passage of the securing element therethrough.

Figure 5B:
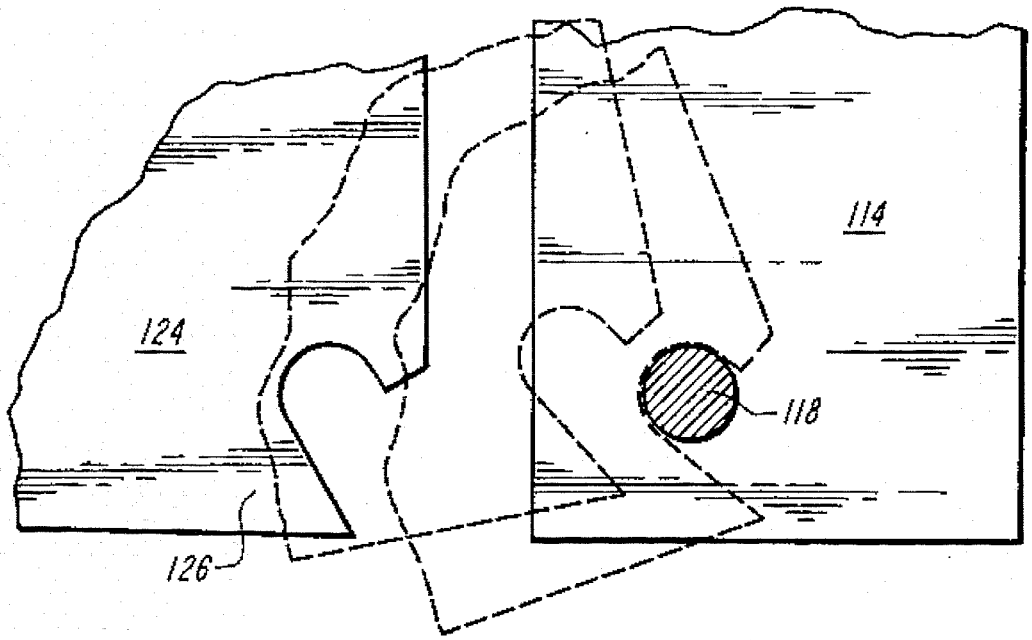

As shown in FIGS. 2, 5A and 5B, near an opposite end of the walls 114 from the location of the alignment element 111 and channels 116 in the female portion 112, and extending between the walls 114 in a direction perpendicular to the first axis, is a transverse member 118. The transverse member 118 is preferably a beam-like crosspiece or post having a curved surface which removably fits with a corresponding transverse member engaging element 126 on the male portion 122 of the second boom section 120.

Figure 3A:
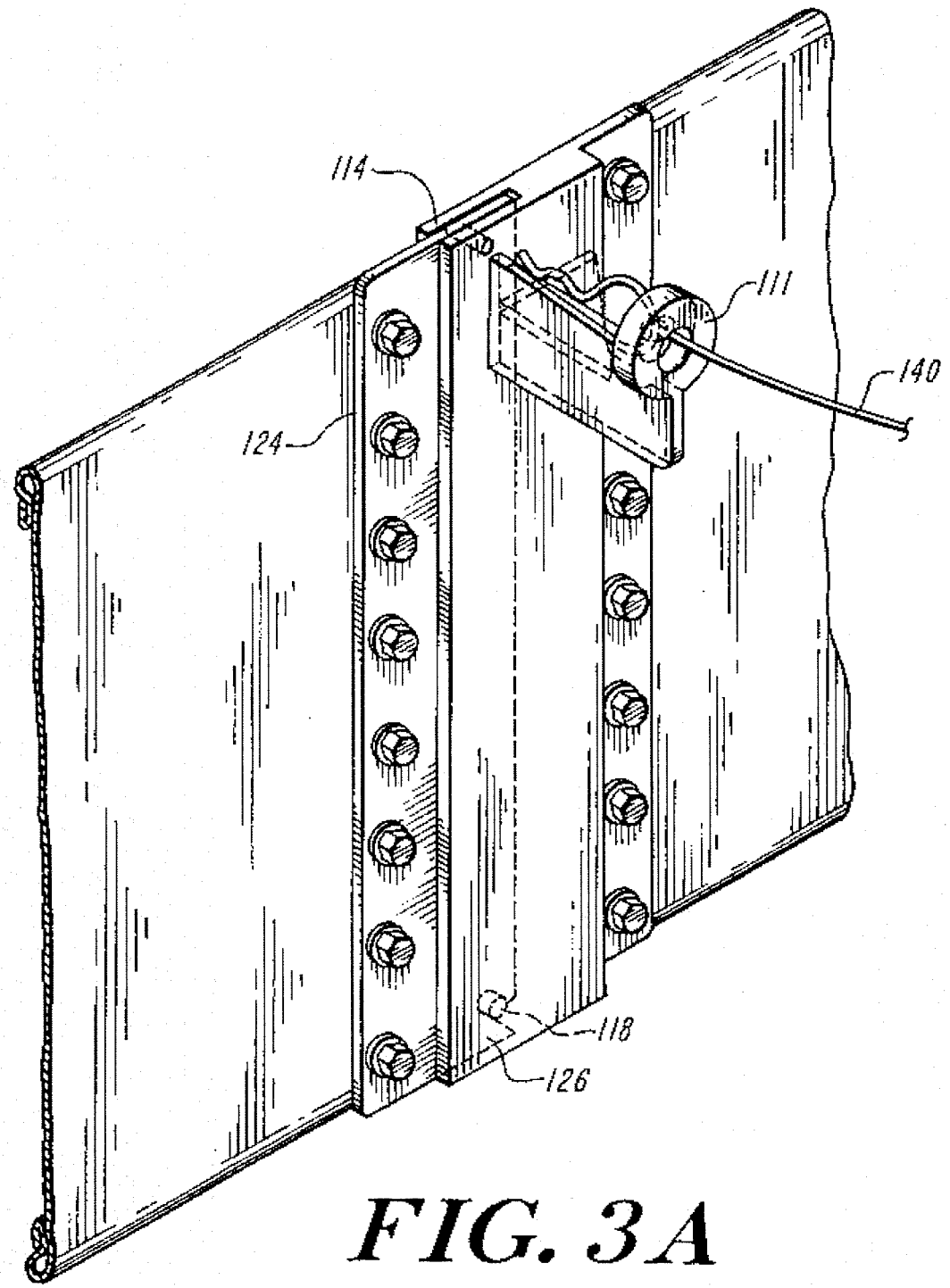
FIGS. 3A–3C are perspective sequential views of one embodiment of a quick release boom connector being disconnected by activation of a remote activating element.
Figure 3B:
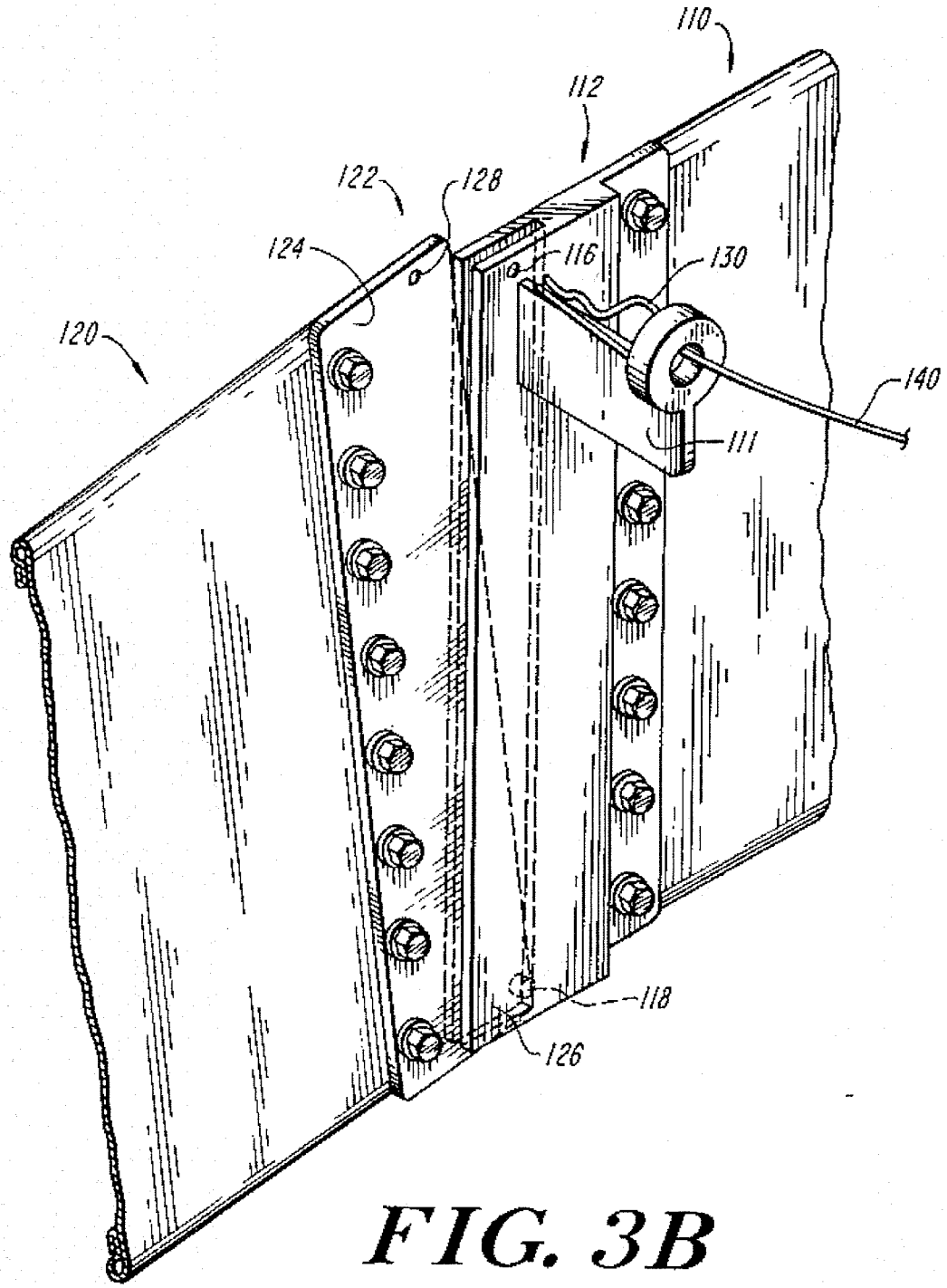
Figure 3C:
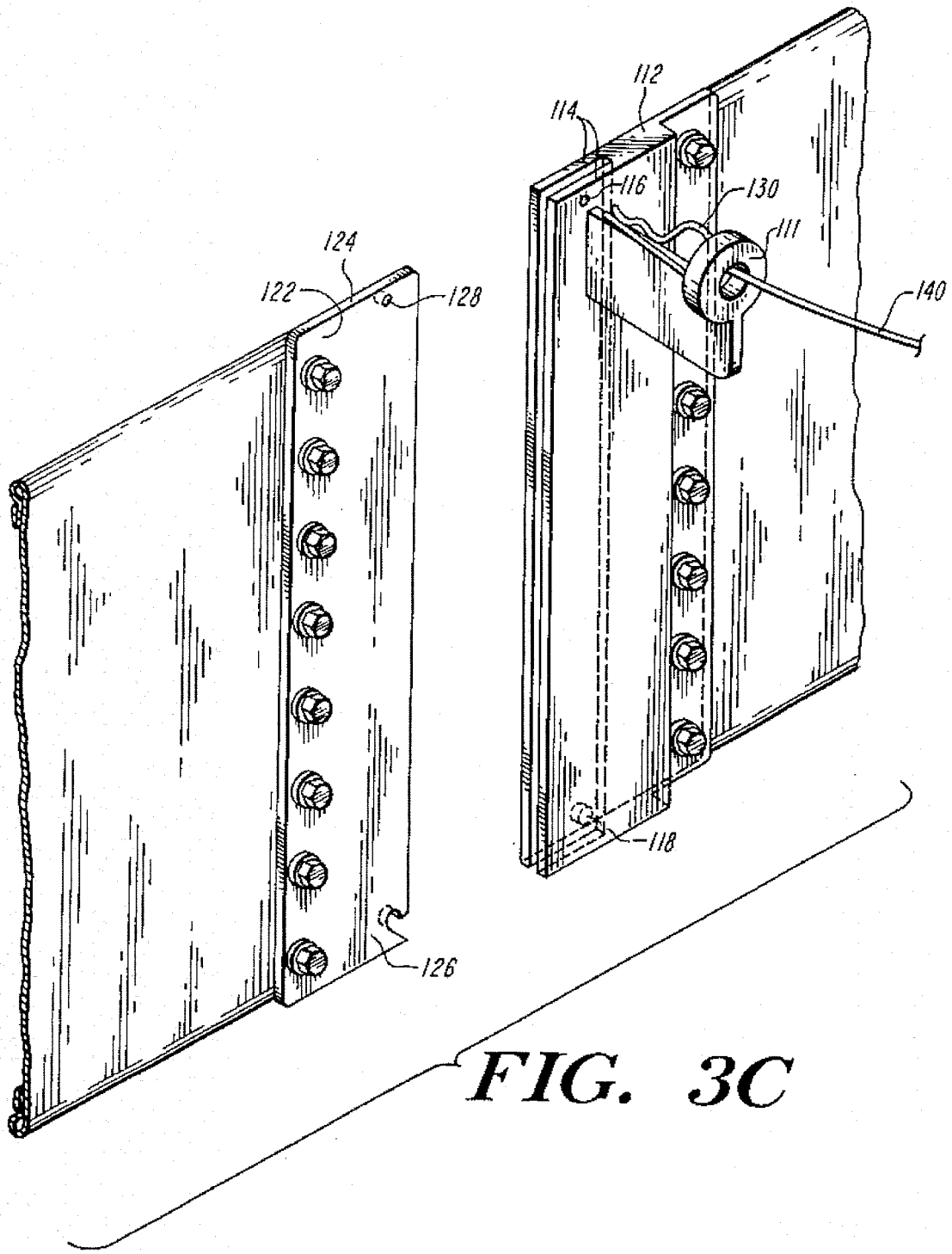
Figure 4A:
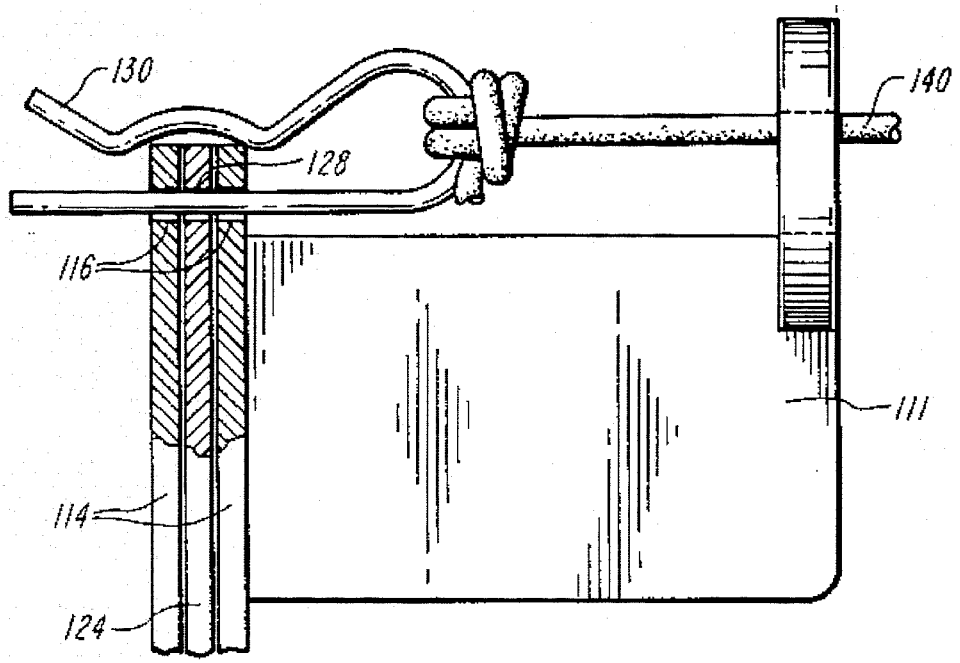
FIGS. 4A–4B are section views of a quick release boom connector having securing and alignment elements according to one embodiment of the invention.
Figure 4B:
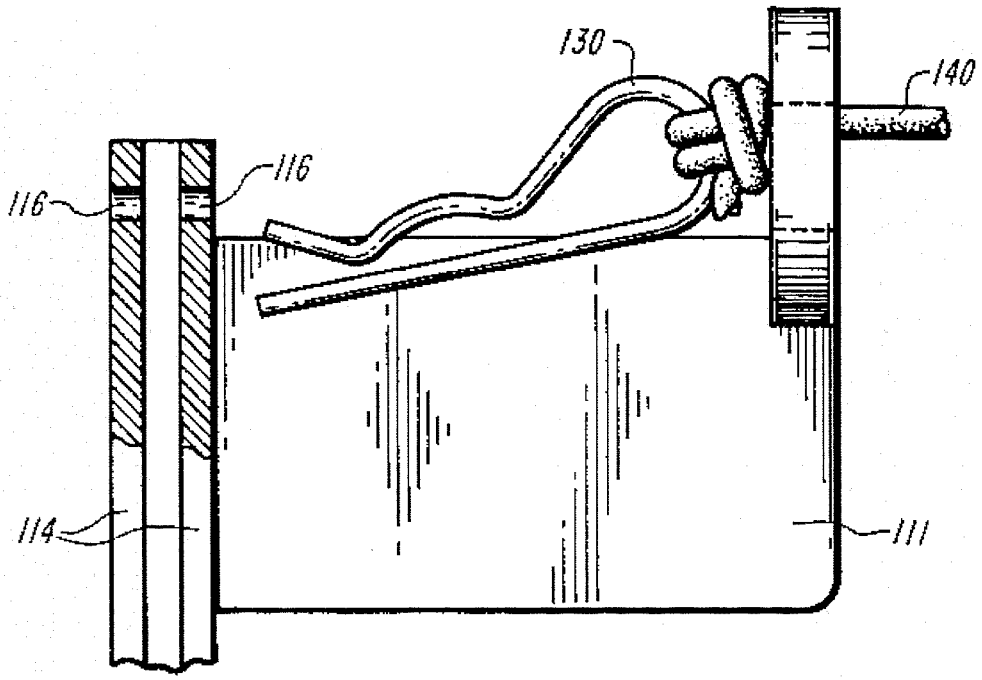

As shown in FIGS. 2, 3A and 4A, a securing element 130, such as a pin, fits within the channels 116 and 128 and extends through both the male and female portions 122 and 112 of the connector 101 to hold them together when they are operatively engaged. The cross-section of the securing element 130 is preferably smaller than the cross-section of the channels 116 and 128 to ensure a removable fit within the channels. Preferred securing elements include straight pins or "hair" pins, as illustrated in FIGS. 1–5, which are lockable and releasable and are easily removed from the channels with a linear, relatively horizontal, application of force.

When the male portion 122 of the connector 101 is in operative contact with the female portion 112, the first and second axes overlap and the channels 116 and 128 are collinear along a third axis perpendicular to the first and second axes. The securing element 130 extends through each of the channels 116 and 128 and holds the male and female portions 122 and 112 together. The transverse member engaging element 126 fits removably with the transverse member 118 for added stability of the connector 101, as shown in FIG. 2.

As shown in FIGS. 1A and 1B, the remote activating element 140 passes through the alignment element 111 on the female portion 112 of the connector 101 so that remote application of force to the activating element 140 withdraws the securing element 130 from the channels 116 and 128.

In another embodiment of the invention, as shown in FIGS. 6A and 6B, the female portion 112' includes a lock element 216 which is preferably pivotably mounted external to one or both of the walls 114'. Similarly, the male portion 122' includes a lock engaging element 226 which extends outwardly from one or both sides of the male portion 122' perpendicular to the second axis and slidably engages with the lock element 216.

As shown in FIGS. 6A, 6B and 7, the lock element 216 is preferably a hook or latch which pivots about a mounting pin 119. In a preferred embodiment, the lock element 216 has a variable or tapered cross-section, illustrated in FIG. 7, for wedged engagement with the lock engaging element 226. The lock engaging element 226 is preferably a post- or beam-like structure with a cross-section which is smaller than the opening of the lock element 216. As shown in FIG. 7, the lock engaging element 226 preferably includes a flange, stop or other surface configuration 226*a* to hold the lock element 216 in place and prevent it from disengaging from the lock engaging element 226 in the absence of force through the activating element 140'.

The lock element 216 can be mounted external to one or both walls 114 of the female portion 112' of the connector. If mounted on both walls, the lock elements 216 are preferably linked to move in tandem with one another in response to movement of the activating element 140'.

In a preferred embodiment of the invention, a plate or bracket 180 can be affixed, such as by welding, to the top and bottom edges of the female portion 112', as shown in FIGS. 6A and 6B. The top and bottom edges of the female portion 112' are preferably angled outwardly with respect to the horizontal axis, as shown in FIGS. 6A and 6B, to assist the engagement of the male and female portions. The plates 180 and the walls 114' of the female portion 112' define a bounded space into which the male portion 122' fits in a wedge fit within the female portion, thereby preventing slippage of the male portion 122' out of the female portion 112' during operative engagement of the boom sections. The plates 180 thus can promote proper alignment of the channels 116' and lock elements 216 and lock engaging elements 226 in the respective boom sections when they are operatively engaged.

An activating element 140 attaches to an end of the securing element 130 and to a remote location, such as pier 90, as shown in FIGS. 1A and 1B. The activating element 140 is preferably a sturdy, relatively heavy rope, cable or wire which can transmit sufficient force from a remote location to disengage the securing element 130 from the connector 101.

As shown in FIGS. 6A and 6B, the remote activating element 140' passes through an alignment element 111' so that remote application of force to the activating element 140' transmits to an opposite end of the pivoting lock element 216, thereby disengaging the lock element 216 from the lock engaging element 226. The lock element 216 acts as a lever with pivot 119 as a fulcrum. In a preferred embodiment, optimum mechanical advantage is provided by reducing the distance between the pivot 119 and the hook end 216*b* of the activating element 140' and by increasing the length of the handle end 216*a* of the lock element 216, as shown in FIG. 6A. Further mechanical advantage is provided by aligning the pivot 119 with the alignment element 111' along an axis parallel to the first and second axes. The fastening elements 113, 115 and 117 located within the swing radius of the handle end 216*a* of the lock element 216 are preferably countersunk in the boom section or otherwise flush with the external surface of the boom section so that they do not interfere with movement of the handle end 216*a* of the lock element 216 or with movement of the activating element 140'.

The boom sections 110' and 120' of the connector 101' can each further include a fin or stiffening element 150, as shown in FIGS. 6A and 6B. The stiffening element 150 extends outwardly in the plane of each boom section from the rear of the boom section, opposite the female portion 112' or the male portion 122' of the respective sections. The stiffening element 150 is preferably made of a rigid material and prevents movement of adjoining boom sections from interfering with, and potentially prematurely disconnecting, the boom connector 101'. The stiffening element 150 further protects the handle end 216*a* of the lock element 216 from interfering with surrounding structures as it swings around pivot 119. In a preferred embodiment, the stiffening element 150 has an arcuate shape which corresponds with the swing of the handle end 216*a* of the lock element 216, with a radius or maximum width dimension which is greater than the swing radius of the handle end 216*a*.

The containment boom 100, including first and second boom sections 110 and 120, is typically made of a durable, relatively rigid, buoyant material, such as, for example, wood or foam cylinders or blocks coated with rubber, vinyl, polymers, or coated fabrics. The male and female portions of the boom, as well as the securing elements and lock elements, are preferably made of aluminum, stainless steel or other durable, relatively lightweight, corrosion-resistant materials.

In the embodiment of the invention illustrated in FIGS. 2–5, the remotely disconnectable containment boom 100 includes a securing element 130 which fits within collinear channels 116 and 128 in the male and female portions 122 and 112 of the connector 101 when they are operatively engaged. The securing element 130 attaches to activating element 140 which connects to a remote location for application of force to the connector 101. Application of force to the activating element 140 disengages the securing element 130 from channels 116 and 128, thereby permitting male and female portions 122 and 112 of the connector 101 to separate under the action of water, such as by natural wind, wave or current action. Alternatively, separation of the boom sections can be enhanced, if necessary and feasible, with the aid of agitation, such as prop wash created by thrusters on a vessel. Alternatively, the boom sections can be separated manually via the activating element 140. Wave and wind action also permit the transverse member engaging element 126 on the male portion 122 to disengage from the transverse member 118 on the female portion 112. The disconnected boom sections 110 and 120 float apart from one another, opening the boom. The dislodged securing element 130 stays with the female portion 112 of the boom section 110, which is connected with the activating element 140 by way of the alignment element 111, as shown in FIG. 1B.

In the embodiment of the invention illustrated in FIGS. 6–7, the remotely disconnectable containment boom includes a lock element 216 on the female portion 112' of the connector 101' which can be a latch or hook that engages with a lock engaging element 226 on the male portion 122' of the connector 101'. The lock element 216 rotates on a pivot 119 and attaches at one end **216*a* to an activating element 140' which connects to a remote location for application of force to the connector 101'. Upon application of force to the activating element 140', the hook end 216*b* of the lock element 216 rotates about pivot 119 away from the lock engaging element 226, thereby disengaging from it and permitting the male and female portions 122' and 112' of the connector 101'** to separate under the action of water and/or wind.

Two or more combustible liquids having different volatilities and flash point properties can thus be transferred simultaneously between vessels over water using the remotely disconnectable containment boom of the present invention. A containment boom with a remotely disconnectable connector is placed around the vessels with the remote activating element attached to a remote location, such as a deck on one of the vessels, for application of force therethrough. The combustible liquids are then simultaneously transferred to respective separate compartments in a receiving vessel. In the event that a low flash point spills appreciably into the water surrounding the vessels, the containment boom can be quickly and remotely opened by application of force to the activating element, thereby permitting the spilled product to float away from the vessels as it dissipates into the atmosphere. This procedure permits safe, simultaneous transfer of high- and low-flash point materials, reduces stress on the loading and receiving compartments in the respective vessels, and reduces demurrage of the loading and receiving vessels.

Other alterations to the above-described embodiments will be readily apparent to those of ordinary skill in the art and are intended to be embraced within the spirit and scope of the invention. That is, the above description is intended to be illustrative rather than limiting. The invention is to be defined, therefore, not by the preceding description but by the claims that follow.

We claim:

1. A remotely disconnectable containment boom, comprising a) a first boom section having a female portion of a quick release boom connector affixed thereto, said female portion having i) a pair of walls in spaced parallel relationship extending along a first axis, each of said walls having a channel perpendicular to said first axis therethrough.

a transverse member disposed between said walls perpendicular to said first axis, and iii) an alignment element mounted externally to one of said walls.

b) a second boom section having a male portion of a quick release boom connector affixed thereto, said male portion having i) a single wall extending along a second axis, ii) transverse member engaging means for engagement with said transverse member on said female portion of said quick release boom connector, and iii) a channel perpendicular to said second axis, whereby when said male portion and said female portion of said boom connector are in operative contact, said channels and said alignment means are collinear.

c) securing means which can be removably disposed within said channels in operation, thereby securing said male and female portions of said boom connector together, and d) remote activating means attached to said securing means for removing said securing means from said channels from a remote location.

2. A remotely disconnectable containment boom according to claim 1 wherein said alignment element comprises an eyelet-containing device.

3. A remotely disconnectable containment boom according to claim 1 wherein said securing means comprises a releasable pin.

4. A remotely disconnectable containment boom according to claim 1 further comprising stiffening means mounted on at least one of said first and said second boom sections.

5. A remotely disconnectable containment boom according to claim 1 wherein said female portion is integral with said first boom section and said male portion is integral with said second boom section.

6. A method of remote disconnection of a containment boom, comprising the steps of:

a) providing a containment boom having a remotely disconnectable connector having i) a first boom section with a female portion of a quick release boom connector affixed thereto, said female portion having a pair of walls in spaced parallel relationship extending along a first axis, each of said walls having a channel perpendicular to said first axis therethrough, a transverse member disposed between said walls perpendicular to said first axis, and an alignment element mounted externally to one of said walls, ii) a second boom section with a male portion of a quick release boom connector affixed thereto, said male portion having a single wall extending along a second axis, transverse member engaging means for engagement with said transverse member on said female portion of said quick release boom connector, and a channel perpendicular to said second axis, whereby when said male portion and said female portion of said boom connector are in operative contact, said channels and said alignment means are collinear, iii) securing means which can removably secure said male and female portions of said boom connector together when said male and said female portions are in operative contact, and iv) remote activating means attached to said securing means for removing said securing means from said channels from a remote location, and b) activating said remote activating means to disconnect said male and female portions of said connector.

7. A method of simultaneously transferring a first combustible liquid and a second combustible liquid from a loading vessel into respective separate compartments of a receiving vessel wherein at least one of said vessels is in water and wherein said first combustible liquid has a first flash point and said second combustible liquid has a second flash point higher than said first flash point, comprising the steps of a) placing a remotely disconnectable containment boom in said water around said vessels, said containment boom having a remotely disconnectable connector having i) a first boom section with a female portion of a quick release boom connector affixed thereto, ii) a second boom section with a male portion of a quick release boom connector affixed thereto, iii) securing means which can removably secure said male and female portions of said boom connector together when said male portion and said female portion are in operative contact, and iv) remote activating means attached to said securing means for removing said securing means from said connector from a remote location, said remote activating means being located on one of said vessels, b) simultaneously transferring said first combustible liquid and said second combustible liquid from said loading vessel into respective separate compartments of said receiving vessel, and c) remotely activating said remote activating means to disconnect said quick release boom connector if said first combustible liquid spills into said water surrounding said vessels.

* * * * *